US005356270A

United States Patent [19]

Bartlett

[11] Patent Number: 5,356,270

[45] Date of Patent: Oct. 18, 1994

[54] ULTRA HIGH VACUUM CRYOPUMP RELIEF VALVE ASSEMBLY

[75] Inventor: Allen J. Bartlett, Milford, Mass.

[73] Assignee: Helix Technology Corporation, Mansfield, Mass.

[21] Appl. No.: 81,524

[22] Filed: Jun. 23, 1993

Related U.S. Application Data

[62] Division of Ser. No. 795,783, Nov. 21, 1991, Pat. No. 5,242,277.

[51] Int. Cl.[5] ..... F04B 49/00

[52] U.S. Cl. ..... 417/307; 417/251; 137/541

[58] Field of Search ..... 417/307, 251, 252; 137/541, 542

[56] References Cited

U.S. PATENT DOCUMENTS

| | | | |
|---|---|---|---|
| 2,335,829 | 11/1943 | McBride | 277/70 |
| 3,425,233 | 2/1969 | Brose | 62/45 |
| 4,232,704 | 11/1980 | Becker et al. | 137/218 |
| 4,697,617 | 10/1987 | Bourke et al. | 137/549 |
| 5,137,050 | 8/1992 | Clarke et al. | 137/541 |
| 5,242,277 | 9/1993 | Bartlett | 417/307 |

OTHER PUBLICATIONS

A. Roth, *Vacuum Technology*, Second, revised edition, North-Holland Publishing Company, 1982, Title page, Copyright page, pp. 416–419 (Chapter 7).

*Primary Examiner*—Richard A. Bertsch
*Assistant Examiner*—Alfred Basichas
*Attorney, Agent, or Firm*—Hamilton, Brook, Smith & Reynolds

[57] ABSTRACT

A secondary pressure relief valve assembly is coupled to a cryopump relief valve for reducing the gas load on the cryopump. The pressure relief valve assembly comprises a main housing mounted to a crypoump exhaust conduit enclosing that portion of the cryopump valve typically exposed to the external environment. A second relief valve is mounted to the main housing and operates in series with the cryopump valve to exhaust pressurized gases from the cryopump during regeneration. A pump is coupled to a port on the main housing and maintains a pressure within the main housing which is less than the pressure of the external environment. As such, the pressure differential across the cyropump valve is reduced. Since the leakage and permeation gas loads are linearly related to the pressure differential, they are correspondingly reduced.

15 Claims, 3 Drawing Sheets

ULTRA HIGH VACUUM CRYOPUMP RELIEF VALVE ASSEMBLY

This application is a division of application Ser. No. 07/795,783, filed on Nov. 21, 1991, now U.S. Pat. No. 5,242,277.

BACKGROUND

Cryopumps currently available, whether cooled by open or closed cryogenic cycles, generally follow the same design concept. A low temperature array, usually operating in the range of 4 to 25K, is the primary pumping surface. This surface is surrounded by a higher temperature radiation shield, usually operated in the temperature range of 70 to 130K, which provides radiation shielding to the lower temperature array. The radiation shield generally comprises a housing which is closed except at a frontal array positioned between the primary pumping surface and a chamber to be evacuated. This higher temperature, first stage frontal array serves as a pumping site for higher boiling point gases such as water vapor.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be proviced in this volume to remove the very low boiling point gases such as hydrogen. With the gases thus condensed and/or absorbed onto the pumping surfaces, only a vacuum remains in the work chamber.

Once the high vacuum has been established, work pieces may be moved into and out of the work chamber through partially evacuated load locks. With each opening of the work chamber to the load lock, additional gases enter the work chamber. Those gases are then condensed into the cryopanels to again evacuate the chamber and provide the necessary low pressures for processing. After continued processing, perhaps over several weeks, gases condensed or adsorbed on the cryopanels would have a volume at ambient temperature and pressure which substantially exceeds the volume of the cryopump chamber. If the cryopump shuts down, that large volume of captured gases is released into the cryopump chamber. To avoid dangerously high pressures in the cryopump with the release of the captured gases a pressure relief valve is provided. Typically, the pressure relief valve is actuated when the cryopump chamber exceeds about 3 pounds per square inch gauge. Because the process gases may be toxic, the pressure relief valve is often enclosed within a housing which directs the gases through an exhaust conduit.

After several days or weeks of use, the gases which have condensed onto the cryopanels and, in particular, the gases which are adsorbed begin to saturate the system. A regeneration procedure must then be followed to warm the cryopump and thus release the gases and to remove the gases from the system. As the gases are released, the pressure in the cryopump increases and the gases are exhausted through the pressure relief valve.

A typical pressure relief valve includes a cap which when the valve is closed, is held against an elastomeric o-ring seal by a spring. With pressures which open the valve, the cap is pushed away from the o-ring seal and the exhausted gases flow past the seal. Along with the gas, debris resulting from processing within the work chamber also pass the seal. As this debris collects on the seal leeking past the seal may result.

For a cryopump operating at Ultra High Vacuum (UHV) pressures ($10^{-9}$ Torr) or lower, conventional o-ring seals are not adequate to maintain the required leak integrity. Thus, valves having metal seals under very high closing force are used in the regeneration path. A metal sealed burst disc is additionally provided as the pressure relief device to satisfy safety requirements. However, this one-shot non-resealing device is expensive and requires replacement after a single use.

SUMMARY OF THE INVENTION

In a cryopump providing UHV pressures or lower ($=10^{-9}$ Torr) and employing a conventional elastomeric pressure relief valve, the elastomeric o-ring seal of the relief valve becomes a significant source of gas load to the cryopump. This gas load is due primarily to permeation and leakage of gases from the external environment though the o-ring and to a lesser extent due to outgassing of the o-ring. As such, the aforementioned metal seal regeneration valve and safety relief burst disc are often employed despite the additional costs and complexity to the system.

In accordance with the present invention, a pressure relief valve assembly is coupled to the cryopump relief valve, enclosing that portion of the cryopump valve typically exposed to the external environment pressure. The pressure relief valve assembly maintains an internal pressure which is preferably at least two orders of magnitude less than the pressure of the external environment. As such, the pressure differential across the cryopump valve o-ring is reduced by at least two orders of magnitude. Further, since permeation and leakage through the o-ring are linearly related to the pressure differential, the gas load on the cryopump due to the o-ring is subsequently diminished by at least two orders of magnitude.

In a preferred embodiment, the pressure relief valve assembly comprises a main housing which is mounted to the cryopump exhaust conduit, enclosing that portion of the cryopump valve typically exposed to the external environment. The main housing has an inlet at one end adjacent to the cryopump valve and an outlet at the opposite end at which a second pressure relief valve is mounted. The second valve is connected in series with the cryopump valve and, like the cryopump valve, includes a cap which is held against an elastomeric o-ring seal by a spring when the valve is closed. When pressure within the main housing opens the valve, the cap is pushed away from the o-ring seal and the exhausted gases flow past the seal. During a safety event or normal regeneration, the second valve operates in series with the cryopump valve to exhaust pressurized gases from the cryopump chamber.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed on illustrating the principles of the invention.

DETAILED DESCRIPTION OF THE INVENTION

Figure 1:
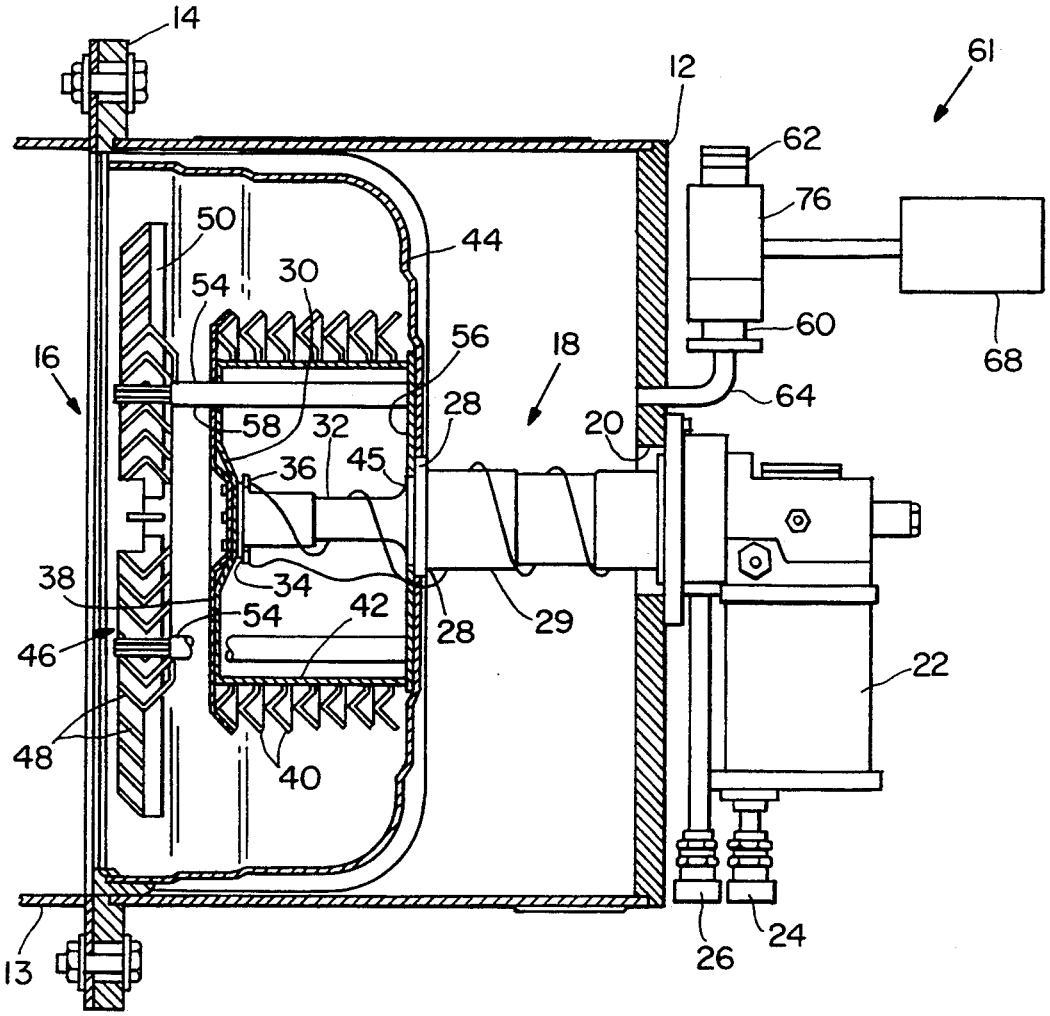
FIG. 1 is a longitudinal cross-sectional view of a cryopump embodying the present invention.

The cryopump of FIG. 1 comprises a main housing 12 which is mounted to a work chamber or a valve housing 13 along a flange 14. A front opening 16 in the cryopump housing 12 communicates with a circular opening in the work chamber or valve housing. Alternatively, the cryopump arrays may protrude into the chamber and a vacuum seal be made at a rear flange. A two stage cold finger 18 of a refrigerator protrudes into the housing 12 through an opening 20. In this case, the refrigerator is a Gifford MacMahon refrigerator but others may be used. A two storage displacer in the cold finger 18 is driven by a motor 22. With each cycle, helium gas introduced into the cold finger under pressure through line 24 is expanded and thus cooled and then exhausted through line 26. Such a refrigerator is disclosed in U.S. Pat. No. 3,218,815 to Chellis et al. A first stage heat sink, or heat station 28 is mounted at the cold end of the first stage 29 of the refrigerator. Similarly, a heat sink 30 is mounted to the cold end of the second stage 32. Suitable temperature sensor and vapor pressure sensor elements 34 and 36 are mounted to the rear of the heat sink 30.

The primary pumping surface is s cryopanel array mounted to the heat sink 30. This array comprises a disc 38 and a set of circular chevrons 40 arranged in a vertical and mounted to disc 38. The cylinder surface 42 holds a low temperature absorbent such as charcoal. Access to this absorbent by low boiling point gases is through chevrons 40.

A cup shaped radiation shield 44 is mounted to the first stage, high temperature heat sink 28. The second stage of the cold finger extends through an opening 45 in that radiation shield. This radiation shield 44 surrounds the primary cryopanel array to the rear and sides to minimize heating of the primary cryopanel array by radiation. The temperature of this radiation shield ranges from about 100° K. at the heat sink 28 to about 130° K. adjacent to the opening 16.

A frontal cryopanel array 46 serves as both a radiation shield for the primary cryopanel array and as a cryopumping surface for higher boiling temperature gases such as water vapor. This panel comprises a circular array of concentric louvers and chevrons 48 joined by spoke-like plates 50. The configuration of this cryopanel 46 need not be confined to circular concentric components; but it should be so arranged as to act as a radiant heat shield and a higher temperature cryopumping panel while providing a path for lower boiling temperature gases to the primary cryopanel.

Thermal struts 54 extend between a plate 56 mounted to the heat sink 28 and the frontal array. Those struts extend through clearance openings 58 in the primary panel 38 and are thus isolated from that panel.

In a typical system, the cryopump is regenerated by turning off the refrigerator and allowing the system to warm. As the temperature of the system increases the gases are released, thus increasing the pressure in the system. As the pressure reaches about 3 PSIG the released gases are exhausted from the system through a cryopump relief valve 60.

In accordance with the present invention, a pressure relief valve assembly (PRVA) 61 is coupled to the cryopump valve 60 for reducing the gas load due to the valve's o-rings 90 and 96 (FIG. 2) on the cryopump. The PRVA 61 is mounted to an exhaust conduit 64 typically provided on cryopump housings. The PRVA 61 includes a pressure relief valve 62 which operates in series with the cryopump valve 60 to release gases from the system during a safety event or normal regeneration. The two valves are coupled together via a main housing 76 which encloses that portion of the cryopump typically exposed to external environment pressure.

Figure 2:
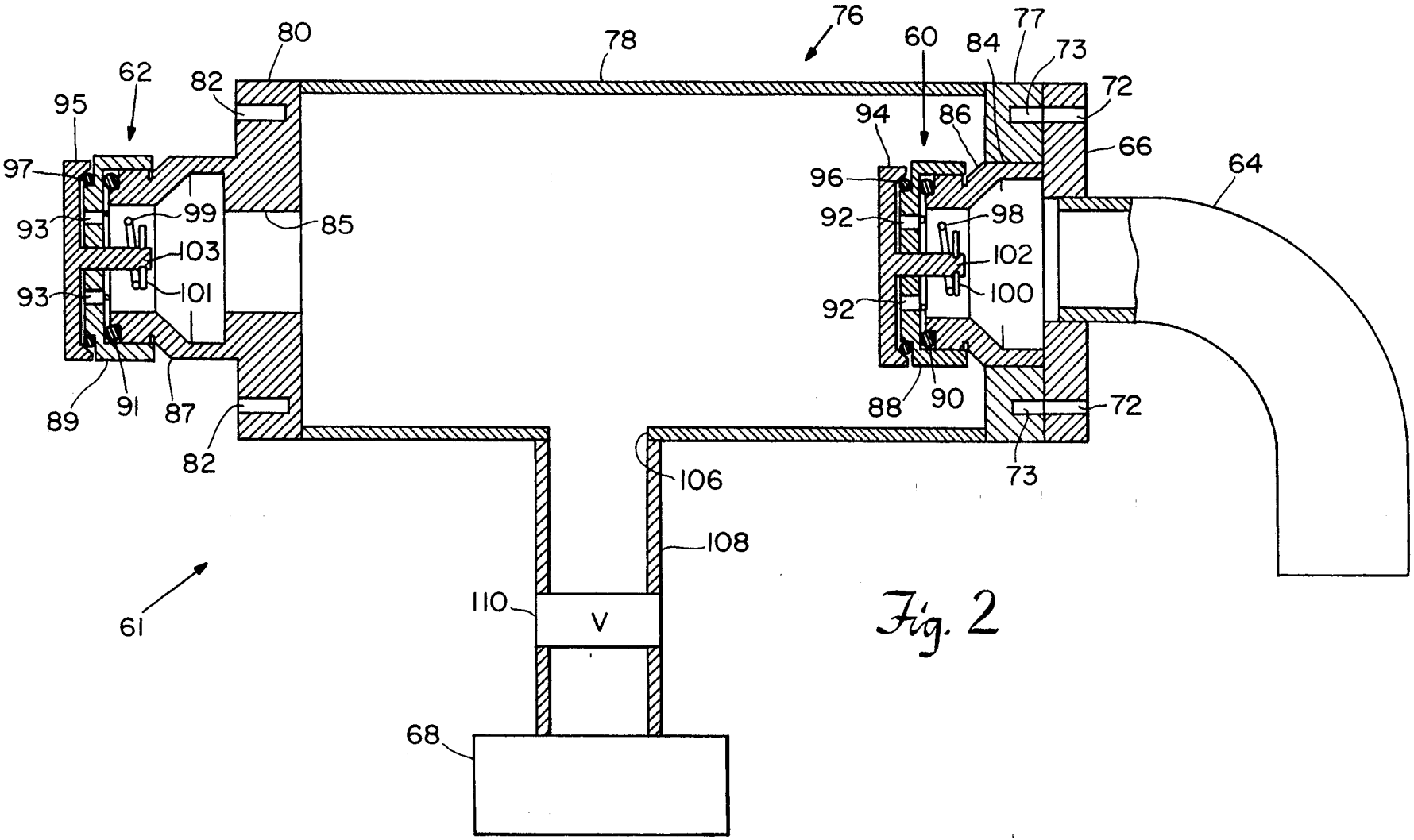
FIG. 2 is a longitudinal cross-sectional view of the relief valve assembly in the system of FIG. 1.

In the preferred embodiment, a roughing pump 68 is coupled to the main housing and maintains a pressure in the main housing which is preferably at least two orders of magnitude less than the pressure of the external environment. Alternatively, the cryopump may be used to pump down the main housing 76 to a pressure which is less than external environment pressure. To that end, the cryopump valve 60 is held open so that the pressure within the main housing 76 may be reduced by the cryopump. When the main housing pressure is at least two orders of magnitude less than external environment pressure, the cryopump valve 60 is closed. In either case, with the main housing pressure being less than the pressure of the external environment, the pressure differential across the cryopump valve's o-rings 90 and 96 (FIG. 2) are reduced accordingly. As stated previously, the gas load associated with the cryopump valve 60 is due primarily to permeation and leakage of gases through the valve's o-ring seals 90 and 96 (FIG. 2). Both permeation and leakage are linearly related to the pressure differential across the valve 60, so the PRVA 61 is employed to reduce the pressure differential across the valve 60 such that the gas load is correspondingly reduced.

In FIG. 1, the conduit 64 is shown as being directed away from the helium lines 24 and 26, but in some systems the conduit is directed parallel to the lines 24 and 26. The PRVA 61 is dimensioned to fit in the latter systems in the space alongside the motor 22 such that they do not extend beyond the cylindrical envelope defined by the cryopump housing.

The details of the pressure relief valve 60 and the pressure relief valve assembly 61 are illustrated in FIG. 2. The exhaust conduit 64 typically includes a flange assembly 66 at its end for mounting of the pressure relief valve 60. The flange 66 includes a valve mount 86 having an externally threaded neck. The pressure relief valve 60 includes a cap 88 which is threaded onto the mount 86 with the o-ring 90 providing a static seal. Gas ports 92 are provided for free flow of gas through the cap 88. The cap 88 is held closed by a closure 94 which is held against an o-ring seal 96 by a compression spring 98. The compression spring 98 is retained by a clip 100 mounted to the end of a stem 102 extending from the closure 94. Holes 72 are provided in the flange for mounting of an exhaust housing which directs gases through the conduit 64 away from the system.

In existing systems, the closure 94 is retained against the o-ring 96 by the spring 98 and by atmosphere pressure when a vacuum is drawn in the cryopump. The spring 98 applies a closing force to the closure 94 which can be overcome by a pressure in the mount 86 which is about 3 PSI above atmosphere.

The PRVA of the present invention 61 comprises a main housing 76 which is mounted to the flange 66, enclosing the cryopump valve 60. More specifically, the valve mount 86 of the cryopump valve 60 extends through an inlet 84. The inlet 84 is formed in an end cap 77 which is welded to a cylindrical portion 78 of the main housing 76. The end cap 77 has holes 74 which are provided for mounting of the main housing 76 to the flange 66. The cylindrical portion 78 is enclosed at the left end, as viewed in FIG. 2, by a cap 80. The cap 80 has threaded bolt holes 82 which match those of the flange 66 for mounting an exhaust housing. An outlet port 85 provided in the end cap 80 leads into a relief valve mount 87 which, in this embodiment, is identical to that on the flange 66.

The pressure relief valve 62 of the PRVA 61 is mounted in series with the cryopump valve 60 and is structurally identical to it. To that end, the valve 62 is threaded onto the mount 87 with an o-ring 91 providing a static seal. Gas ports 93 are provided for free flow of gas through a cap 89. A closure 95 which holds the cap 87 closed is held against an o-ring seal 97 by a compression spring 99. The compression spring 99 is retained by a clip 101 which is mounted to a stem 103 extending from the closure 95. During a safety event or normal regeneration, the two valves 60 and 62 actuate in series to relieve the internal pressure of the cryopump to atmospheric pressure. Upon evacuation, both valves automatically reseal.

To reduce the gas load associated with the cryopump relief valve 60, a vacuum pump 68 is provided to maintain pressure within the main housing which is less than atmospheric pressure. The pump 68 is connected to a port 106 of the main housing 76 via a conduit 108. An isolation valve 110 is provided for isolating the pump from the main housing 76 during regeneration. Preferably, the pump 68 is capable of maintaining a substantial range of pressures within the main housing 76 such that the gas load can be reduced to any level. For example, suppose it is desired to reduce the gas load associated with valve 60 by a factor of 10,000 where the pressure of the external environment is atmospheric pressure (760 Torr). By adjusting the pump 68 to maintain a pressure within the main housing which is 1/10,000th of atmospheric pressure (i.e., 0.076 Torr), the pressure differential as well as the permeation and leakage gas load is reduced by a factor of 10,000.

Figure 3:
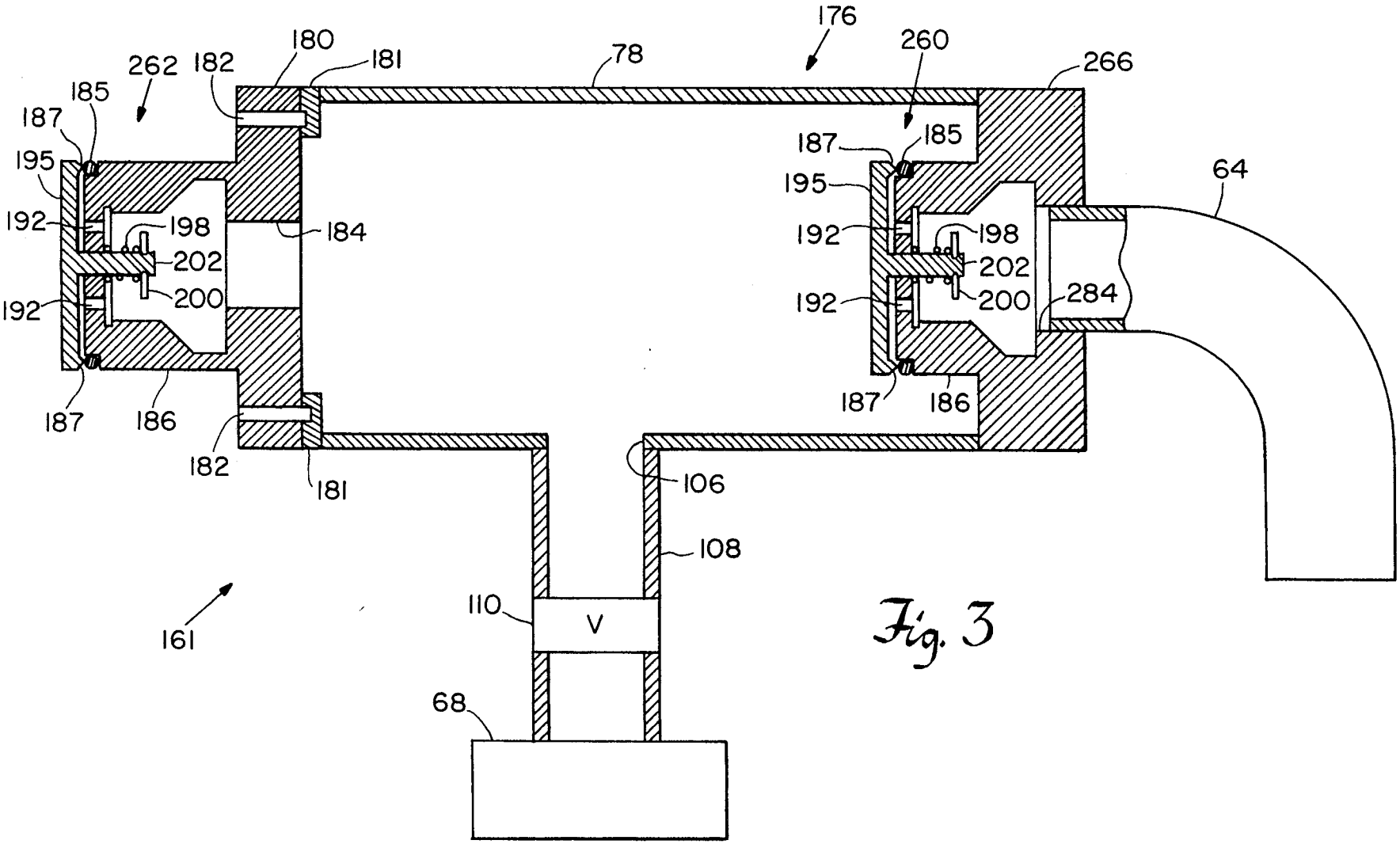
FIG. 3 is a longitudinal cross-sectional view of an alternative pressure relief valve assembly.

An alternative embodiment of the pressure relief valve assembly is shown in FIG. 3. While the PRVA of FIG. 2 with its complementary threads is readily retrofitted to cryopump equipment, the PRVA of FIG. 3 comprises a pair of relief valves 260 and 262 which are integrally coupled to the exhaust conduit 64. To that end, the flange 266 and the valve mount 286 are a unitary structure welded directly to the exhaust conduit 64. As such, the valve 260 and the main housing 176 are no longer removable from the system. However, access to the valve 260 is provided through a removable end cap 180. The end cap 180 is bolted to a flange 181 welded to the cylindrical portion 78 of the main housing 176. Access to the valve 260 is possible by removing bolts (not shown) from bolt holes 182.

The PRVA of FIG. 3 employs a pair of self-cleaning pressure relief valves 260 and 262 which are disclosed in U.S. patent application, Ser. No. 07/334,921 to Clarke et al. The first valve 260 has a valve mount 186 extending from the flange 266. The valve mount 186 has an annular groove in which o-ring 185 is mounted. The valve mount also has a number of circumferential holes 192 about one larger hole passing through the middle. Extending through the center hole is a shaft 206 of a valve closure 195 which slides axially within the hole. The motion of the closure 195 is by the force of spring 198 which is compressed between the mount 186 and a retaining nut 200 on the cylindrical shaft of the closure 195. The force of the spring acts to bring a contact edge 189 of the closure 195 against the o-ring 185 to seal the valve 260.

The second pressure relief valve 262 is mounted in series with the first valve 260 and is identical to it. During a safety event or normal regeneration, the two valves actuate in series to relieve the internal cryopump pressure to atmospheric pressure. Upon evacuation, both valves automatically reseal.

While the invention has been particularly shown and described with reference to preferred embodiments thereof, it will be understood by those skilled in the art that various changes in form and details may be made therein without departing from the spirit and scope of the invention as defined by the appended claims.

I claim:

1. A cryopump pressure relief valve assembly comprising:

a main housing having an inlet at one end and an outlet at another end, the main housing inlet being in communication with a cryopump pressure relief valve which is attached to an exhaust conduit of a cryopump, the cryopump valve having an outlet adjacent to the main housing inlet such that the cryopump valve outlet and the main housing inlet form a fluid path into the main housing;

a second pressure relief valve in communication with the main housing and having an outlet adjacent to the main housing outlet such that the second valve outlet and the main housing outlet form a fluid path out of the main housing; and a vacuum pump coupled to the main housing for maintaining a pressure within the main housing less than a pressure external to the main housing.

2. A cryopump pressure relief valve assembly as claimed in claim 1 wherein the vacuum pump coupled to the main housing maintains a pressure within the main housing of at least two orders of magnitude less than a pressure external to the main housing.

3. A cryopump pressure relief valve assembly comprising:

a main housing having an inlet at one end and an outlet at another end;

a first pressure relief valve within the main housing and coupled to an exhaust conduit of a cryopump, the first valve having an outlet in communication with the main housing inlet such that the main housing inlet and the first valve outlet form a fluid path into the main housing;

a second pressure relief valve in communication with the main housing having and having an outlet adjacent to the main housing outlet such that the second valve outlet and the main housing outlet form a fluid path out of the main housing; and a vacuum pump coupled to the main housing for providing a pressure within the main housing less than a pressure external to the main housing.

4. A cryopump pressure relief valve assembly as claimed in claim 3 wherein the vacuum pump coupled to the main housing provides a pressure within the main housing of at least two orders of magnitude less than a pressure external to the main housing.

5. A cryopump pressure relief valve assembly as claimed in claim 4 wherein the first valve and the second valve actuate in series to exhaust pressurized gases from the cryopump.

6. A pressure relief valve assembly comprising:

a main housing having an inlet at one end and an outlet at another end, the main housing enclosing a housing of a first pressure relief valve mounted to an exhaust conduit, the valve housing having an outlet opposite to the main housing inlet such that the main housing inlet and the valve housing outlet form an in-line fluid path into he main housing, the valve also having a valve closure, spring and o-ring for closing the valve housing, the o-ring being pressed between the closure and the valve housing, the spring being positioned within the valve housing for pulling the closure against the o-ring;

a second relief valve housing in communication with the main housing and having a second valve housing outlet opposite to the main housing outlet such that the second valve housing outlet and the main housing outlet form an in-line fluid path out of the main housing;

a second valve closure, second spring and second o-ring for closing the second valve housing, the second o-ring being pressed between the second closure and second valve housing, the second spring being positioned within the second valve housing for pulling the second closure against the second o-ring; and a vacuum pump coupled to the main housing for providing a pressure within the main housing less than a pressure external to the main housing.

7. A pressure relief valve assembly claimed in claim 6 wherein the exhaust conduit is attached to a cryopump.

8. A pressure relief valve assembly as claimed in claim 7 wherein the first valve and the second valve actuate in series to exhaust pressurized gases from the cryopump.

9. A pressure relief valve assembly as claimed in claim 7 wherein the vacuum pump coupled to the main housing provides pressure within the main housing that is at least two orders of magnitude less than a pressure external to the main housing.

10. A pressure relief valve assembly comprising:

a main housing having an inlet at one end, an outlet opposite to the inlet at the other end and a pumping port, the main housing enclosing a housing of a cryopump relief valve mounted to an exhaust conduit of a cryopump, the valve housing having an outlet opposite to the main housing inlet such that the main housing inlet and the valve housing outlet form an in-line fluid path into the main housing, the valve also having a valve closure, spring and o-ring for closing the valve housing, the o-ring being pressed between the closure and valve housing, the spring being positioned within the valve housing for pulling the closure against the o-ring;

a second relief valve housing in communication with the main housing and having a second valve housing outlet opposite to the main housing outlet such that the second valve housing outlet and the main housing outlet form an in-line fluid path out of the main housing;

a second valve closure, second spring and second o-ring for closing the second valve housing, the second o-ring being pressed between the second closure and second valve housing, the second spring being positioned within the second valve housing for pulling the second closure against the second o-ring; and a vacuum pump coupled to the pumping port of the main housing for providing a pressure within the main housing of at least two orders of magnitude less than a pressure external to the main housing.

11. A method of relieving pressure in a cryopump comprising:

providing a first pressure relief valve in communication with a cryopump housing and a second pressure relief valve in communication with the first pressure relief valve via a region between the first and second valves having a pressure which is less than the pressure of the external environment;

actuating the first valve and the second valve in series for relieving the pressure within the cryopump housing; and providing a vacuum pump coupled to the main housing for maintaining a pressure within the main housing less than a pressure external to the main housing.

12. The method of claim 11 further comprising providing a main housing having an inlet at one end in communication with the cryopump housing and an outlet at another end, the first valve having an outlet in communication with the main housing inlet forming a fluid path into the main housing and the second valve having an outlet in communication with the main housing outlet forming a fluid path out of the main housing.

13. The method of claim 11 wherein the vacuum pump coupled to the main housing maintains a pressure within the main housing of at least two orders of magnitude less than a pressure external to the main housing.

14. The method of claim 12 wherein the first and second valves each have a valve housing coupled to the main housing and a valve closure, spring and o-ring for closing the valve housing, the o-ring being pressed between the closure and valve housing and the spring being positioned for pulling the closure against the o-ring.

15. A method of relieving pressure in a cryopump comprising:

providing a main housing having an inlet at one end coupled to an exhaust conduit of a cryopump and an outlet at another end, a first pressure relief valve having an outlet in communication with the main housing inlet to form a fluid path into the main housing, a second pressure relief valve having an outlet in communication with the main housing outlet to form a fluid path out of the main housing, and a vacuum pump coupled to the main housing for maintaining a pressure within the main housing of at least two orders of magnitude less than a pressure external to the main housing; and actuating the first valve and the second valve in series for relieving the pressure within the cryopump.

* * * * *